US007353554B2

(12) United States Patent
Wang

(10) Patent No.: US 7,353,554 B2
(45) Date of Patent: Apr. 8, 2008

(54) FLOATING WATER BED

(76) Inventor: Yi Jing Wang, 18428 Desidia St. #C, Rowland Heights, CA (US) 91748

( * ) Notice: Subject to any disclaimer, the term of this patent is extended or adjusted under 35 U.S.C. 154(b) by 0 days.

(21) Appl. No.: 11/496,785

(22) Filed: Aug. 1, 2006

(65) Prior Publication Data

US 2008/0047062 A1 Feb. 28, 2008

(51) Int. Cl.
*A47C 27/08* (2006.01)

(52) U.S. Cl. ..... 5/665; 5/422; 5/669; 5/413 R

(58) Field of Classification Search ..... 5/665, 5/422, 668, 669, 676–678, 687, 413 R; 607/81, 607/85, 86
See application file for complete search history.

(56) References Cited

U.S. PATENT DOCUMENTS 1,943,888 A * 1/1934 Ewald ..... 5/665
4,079,728 A * 3/1978 Gatts ..... 600/22
4,094,025 A * 6/1978 Nystad ..... 5/665
4,662,010 A * 5/1987 Silberling ..... 5/686
4,680,820 A * 7/1987 Bittner ..... 5/665
4,727,607 A * 3/1988 Nystad ..... 5/678
5,068,935 A * 12/1991 Hagopian ..... 5/679
6,910,235 B2 * 6/2005 Lack et al. ..... 5/413 AM
6,986,178 B2 * 1/2006 Turner ..... 5/413 R

* cited by examiner

*Primary Examiner*—Michael Trettel
(74) *Attorney, Agent, or Firm*—Raymond Y. Chan; David and Raymond Patent Firm

(57) ABSTRACT

The floating water bed includes a specially designed unique sleeping bag and a movable mattress pad. The sleeping bag is both thin and soft and it is placed on top of the movable mattress pad. This movable mattress pad can be lowered or risen from the water. As the human being rests within the sleeping bag, with the press of a button, the mattress pad can be lowered into the water along with the sleeping bag and the individual inside. At this time, the individual inside the sleeping bag will be floating in mid-water and will begin experiencing soothing relaxation. The floating water bed will have a well-shaped hole perpendicular to the sleeping bag and rising out of the water, providing the individual with an entrance into the sleeping bag as well as a breathing space once they are within the sleeping bag. With this well-shaped hole, the individual can breathe easily without the use of oxygen masks or additional equipment. This new floating water bed can then truly produce the effects of reducing stress, increasing bodily strength, improving sleep, and relieving muscular fatigue.

18 Claims, 7 Drawing Sheets

FLOATING WATER BED

BACKGROUND OF THE PRESENT INVENTION

This new invention is called, the floating water bed. This new innovation is different from all previous known water beds. This new water bed is modeled after the idea that: when any solid object is placed in water, the water will exert a force on this solid object. When the specific gravity of the object is less than that of the water, the object will float on the water. When the specific gravity of the object is equal to or greater than that of the water, the object will float in mid-water or sink to the bottom. When the object is floating in mid-water, the pressure exerted by the water onto this object is evenly distributed throughout the surface of this object. This same idea can be applied to when a human body is placed in water. Since the specific gravity of a human is greater than that of water, the human being will like wise float in mid-water or sink to the bottom. The amount of pressure exerted by the water onto the human being is evenly distributed throughout the surface of the human as well. At this time, the human being will experience a loosening and relaxing of all the various muscles within the body. The human being will not experience significant pressure in any one spot of his body since the pressure is evenly distributed throughout. This method can be used to reduce an individual's muscular fatigue, reduce stress, improve sleep, increase bodily strength and produce numerous other benefits.

SUMMARY OF THE PRESENT INVENTION

The floating water bed is therefore designed after this therapeutic method. Its specialty includes a specially designed unique sleeping bag and a movable mattress pad. The innovative sleeping bag is both thin and soft and it is placed on top of the movable mattress pad. This movable mattress pad can be lowered or risen from the water. As the human being rests within the sleeping bag, with the press of a button, the mattress pad can be lowered into the water along with the sleeping bag and the individual inside. At this time, the individual inside the sleeping bag will be floating in mid-water and will begin experiencing soothing relaxation. The floating water bed will have a well-shaped hole perpendicular to the sleeping bag and rising out of the water, providing the individual with an entrance into the sleeping bag as well as a breathing space once they are within the sleeping bag. With this well-shaped hole, the individual can breathe easily without the use of oxygen masks or additional equipment. This new floating water bed can then truly produce the effects of reducing stress, increasing bodily strength, improving sleep, and relieving muscular fatigue.

DETAILED DESCRIPTION OF THE PREFERRED EMBODIMENT

As mentioned above, the Floating Water Bed, is a completely new and never before seen product.

Figure 1:
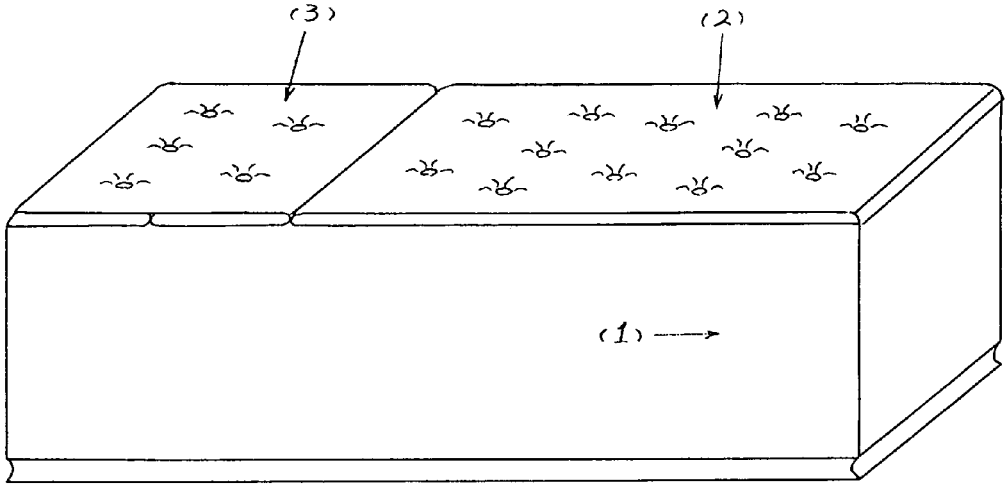
FIG. 1 is a perspective view of a floating water bed according to a preferred embodiment of the present invention.
Figure 2:
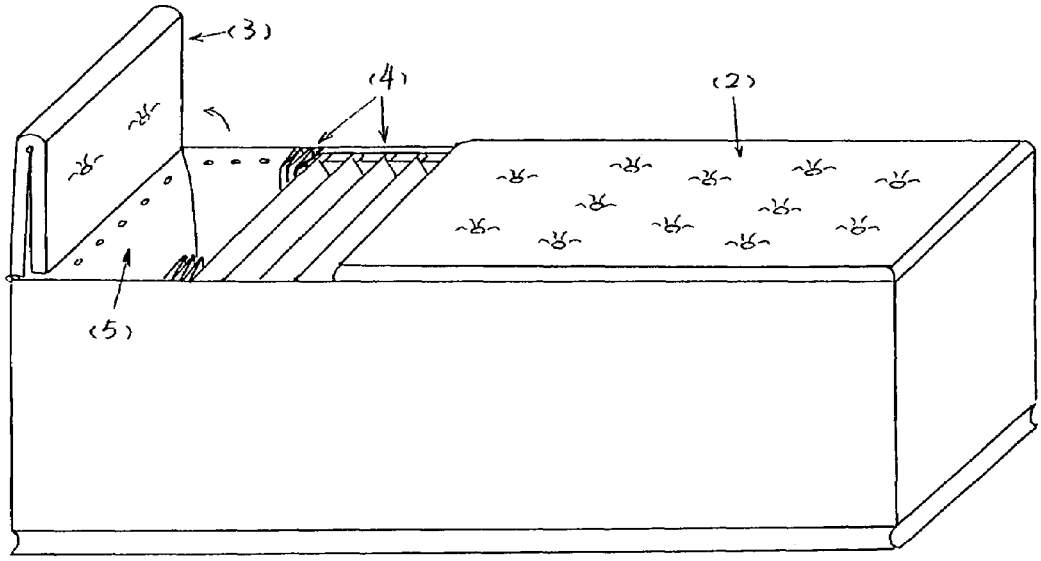
FIG. 2 is a perspective view of the floating water bed with the bed surface halfly opened according to the above preferred embodiment of this invention.

First, this new product is produced for the purpose of allowing human beings to rest and relax. Therefore, the outer appearance of this product is similar to the outer appearance of traditional bed mattresses. The difference is the Floating Water Bed is sealed all around while the traditional mattress is hollow. Please see drawings FIG. 1 and FIG. 2 for the following descriptions:

Numbers (2) and (3) illustrate the surface of the Floating Water Bed. The inner layer of the surface (2) (3) can be made from sponge-like or other soft material to produce a cushioning for the surface (2) (3). The outer layer of the bed surface (2) (3) can be produced by using leather or other similar material and wrapping it around the inner sponge-like material. Then use round pins on the surface (2) (3) of the Floating Water Bed to secure the leather to the inner sponge layer. This will produce a bed surface that is both three dimensional and pleasing to the eye. The pins will also prevent the sponge cushioning from moving underneath the leather wrapping. In the drawing, surface (3) can be retracted and folded for the purpose that when it is closed, it together with surface (2) in the drawing can produce a whole bed surface. An individual can choose to rest on this bed surface (2) (3) as he would on a regular bed mattress. When surface (3) is opened but folded, it can become a back rest for the individual as he climbs into a sleeping bag (6) that has just been lifted from the water and towards the bed surface (2) (3). Number (5) in the drawing illustrates a well-shaped hole that can provide for entrance into the sleeping bag (6) as well as a breathing hole for the individual inside the sleeping bag (6). Number (1) in the drawing illustrates the surrounding walls of the bed structure. These walls (1) can be made by using wood or other similar hard materials.

Figure 3:
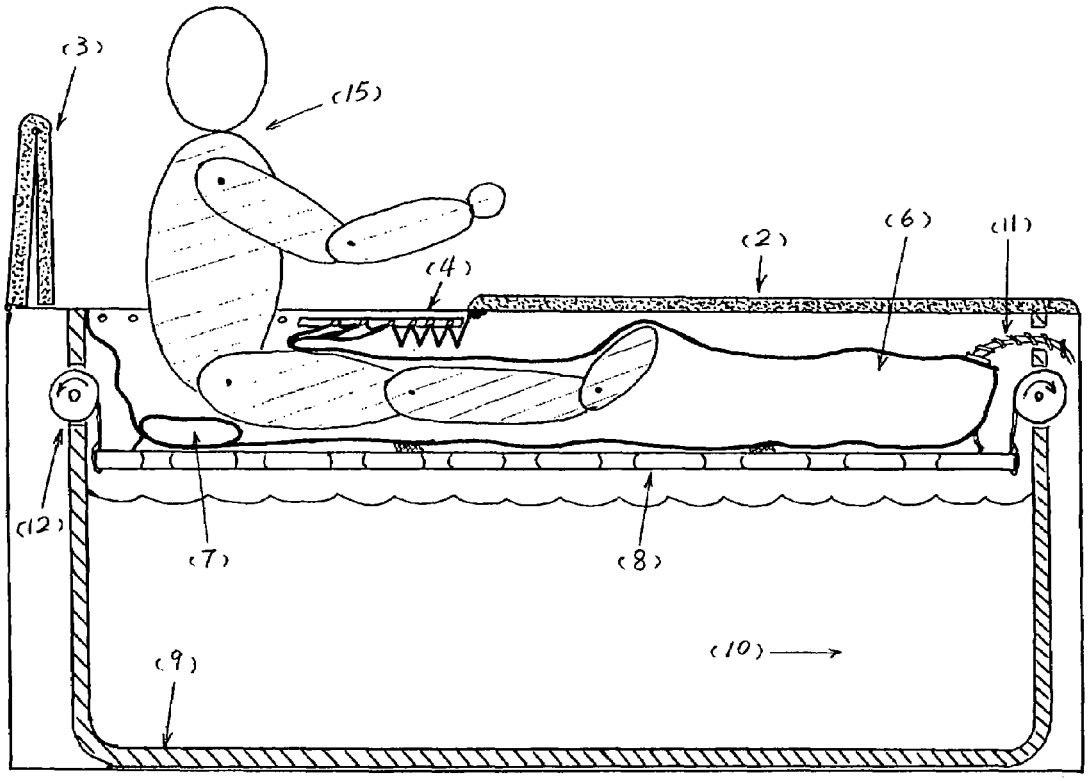
FIG. 3 is a sectional view of the floating water bed with a sitting user according to the above preferred embodiment of this invention.
Figure 4:
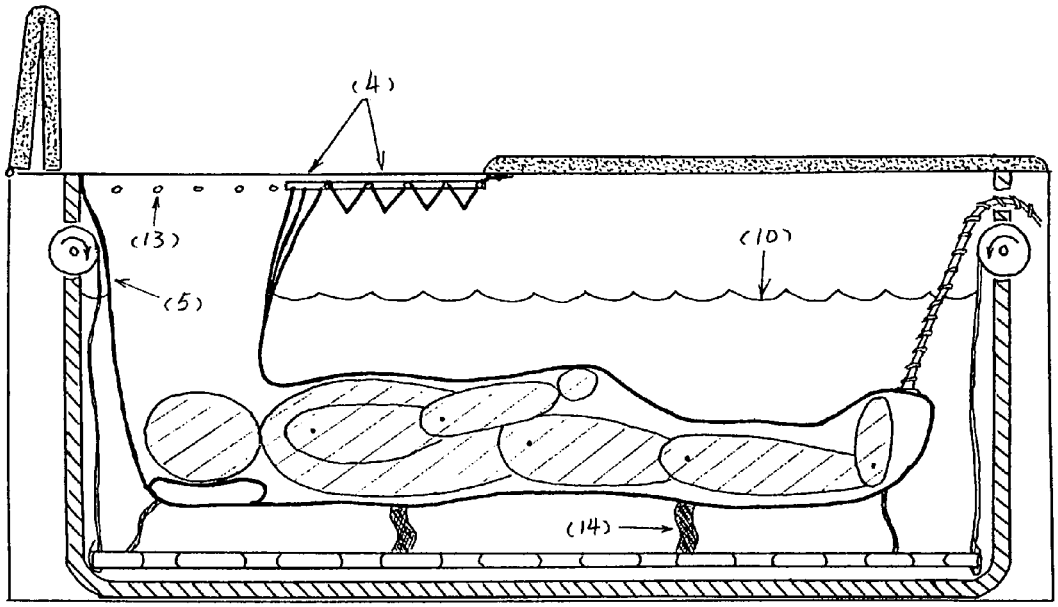
FIG. 4 is a sectional view of the floating water bed with a lying user according to the above preferred embodiment of this invention.
Figure 5:
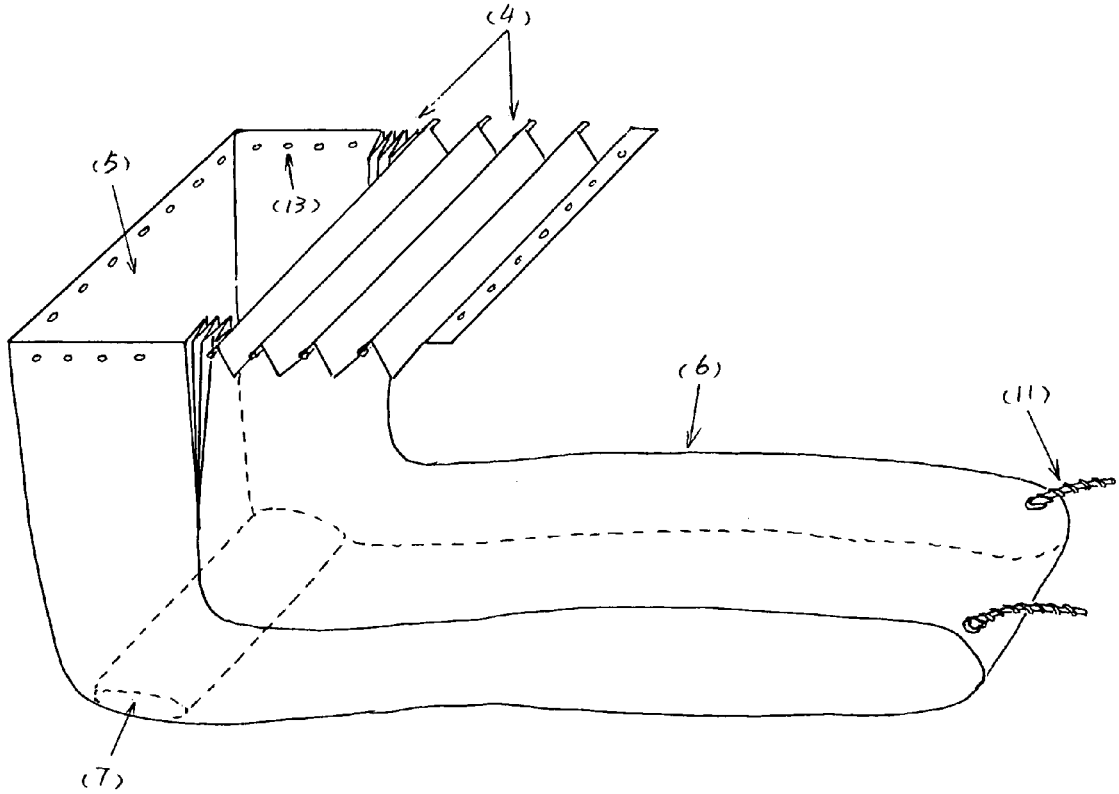
FIG. 5 is a sectional perspective view of the water tub of the floating water bed according to the above preferred embodiment of this invention.

Please see drawings FIG. 3, FIG. 4 and FIG. 5 for the following description:

Number (9) illustrates a big water tub and it is located within the surrounding walls (1). It is made from strong plastic material and the size of the tub is approximately 90 inches in length, 50 inches in width, and 35 inches in height (90"×50"×35"). The thickness of the tub (9) cannot be less than 0.5 inches to assure ample supporting strength. (The actual size of the tub should be determined according to need and determined after conducting many tests of durability and stability). The tub (9) will also have an outlet for water to enter and another one for water to exit the tub (9). In addition, the tub (9) will have tubes connected to it made from the same material as the tub (9) itself. Because these aspects of the Floating Water Bed are not the main points of this invention, no further detail will be listed.

The sleeping bag (6) is the main point of this invention, it is a unique and innovative sleeping bag and it is consisted of four parts. The first part, as shown in the drawing, is the opening (5) of the sleeping bag. This is the most crucial part of the sleeping bag design. Because consumers will vary in length, size and weight, the opening (5) of the sleeping bag (6) must be easy to expand or contract to allow everyone easy access into the sleeping bag (6). Therefore, the front and sides of this opening (5) is designed to be fan-like structures. Number (4) illustrates the four fan-like structures at the front of the sleeping bag (6). Number (13) illustrates pins securing the sleeping bag (6) to the walls (1) of the water tub (9). Number (4) illustrates the fan-like structures at the side of the water tub (9). When these structures (4) are folded against the sides of the tub (9), the opening (5) of the sleeping bag (6) as expanded to its maximum width. When these fan-like structures (4) are pulled towards each other, the width of the sleeping bag opening (5) is being contracted to its minimum. It is taking into consideration that when consumers are sleeping within the sleeping bag (6), some may choose to sleep on their backs while others choose to sleep on their sides. To allow for easy breathing no matter which position consumers choose to sleep in, a well-shaped hole perpendicular to the sleeping bag (6) was created opening (5) in the drawing. The fan-like structure (4) at the front of the sleeping bag opening (5) is secured to the surface of the bed; the other three sides of the sleeping bag (6) are secured to the top of the surrounding walls (1) of the water tub (9). This is to prevent the sleeping bag (6) from moving away from the walls (1) of the tub (9). The opening (5) of the sleeping bag (6) extends from the surface (2) (3) of the Floating Water Bed all the way to the bottom of the sleeping bag (6). The length of the opening (5) is long enough for the sleeping bag (6) to be lowered into the water without any obstacles. When an individual is floating mid-water, the opening (5) of the sleeping bag (6) is positioned to be directly above the head of the individual within the sleeping bag (6). This will ensure that the individual can breathe easily and normally. On the top of the two sides of the water tub (9), there are two creases, one on each side of the tub (9) along the top. On the front of the sleeping bag (6), at each folded section of the fan-like structure (4), there is a piece of wire extending through that section. The two ends of these wires are placed within the creases along the top of the tub wall (1) so as then fan-like structure (4) is being moved, those wires can move freely along the crease. In addition, it secures the fan-like structure (4) along the top of the tub walls (1) so that even though the sleeping bag (6) itself is soft, the structure (4) will not fall and collapse. The length of the creases along the top of the tub wall (1) also determined the size of the opening (5) of the sleeping bag (6).

Figure 6:
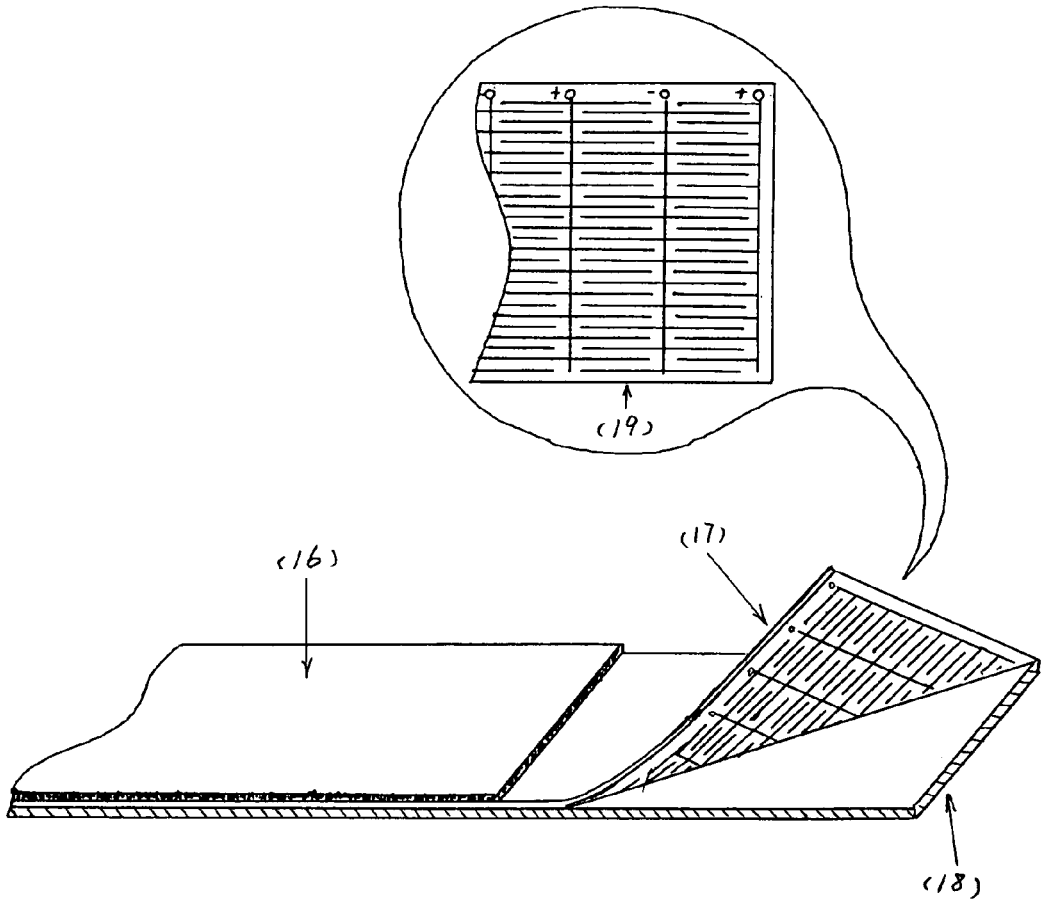
FIG. 6 is a perspective view of the sleeping bag of the floating water bed according to the above preferred embodiment of this invention.

The body of the sleeping bag, labeled number (6) in the drawing, has the approximate length of 75 inches, width 40 inches and thickness of 15 inches (75"×40"×15"). It ensures that individuals within the sleeping bag (6) will have ample room to turn and move his limbs. In addition, the sleeping bag (6) is designed to the soft and thin. The thickness of the sleeping bag (6) cannot exceed 4 mm. The sleeping bag (6) consists of three layers all sticking together, refer to FIG. 6 for the following descriptions:

The outer most layer is a waterproof layer labeled number (18) in the drawing. It must be soft, resilient and stretchable and it is made from latex rubber. The middle layer is an electric protection layer number (17) in the drawing. It must be a thin layer of plastic, no thicker than 0.5 mm. On the side closer to the waterproof layer, there are numerous circuit traces printed on the plastic using a mixture of the copper power and special glue. These circuit traces are either positive or negative and they are arranged closely together in an interchangeable parallel pattern of positive and negative then negative and positive. The width of these circuit traces are uniformly designed to be 2 mm. The space between each pair of positive and negative circuit traces are uniformly designed to be 1 mm, refer to number (19) on the drawing for a visual of these circuit traces. In a normal situation, positive and negative circuits do not pass through to each other. However, when the sleeping bag (6) begins to deteriorate after long time of use and water begins to seep into the layers (17) (18) of the sleeping bag (6), the positive negative circuits within this middle layer (17) will automatically pass electricity to each other. Even the smallest drop of water will cause this reaction to begin. These circuit (19) traces will immediately notify the protection circuit board to lift the sleeping bag (6) out of the water and raise the sleeping bag (6) to the top to ensure the safety of the individual inside. (In order to aide the middle protection layer, ample amounts of salt must be present in the water within the water tub (9) to increase the water's ability to conduct electricity. This large amount of salt and water should be 50:1.) Because the protection circuit is not a main aspect of this invention and because such circuit boards already exist, no further detail will be described about such circuit boards.

The third or inner most layer, labeled number (16) in the drawing, can be made by using either corduroy or flannel material. The purpose of the inner most layer (16) is make the inside of the sleeping bag (6) feel soft to the touch and thus providing comfort for the individual inside. Lastly, these three layers (18) (17) (16) are stuck together to create one layer of the sleeping bag bedding.

The third aspect of the sleeping bag (6) is the air filled pillow labeled number (7) in the drawing. The design of this pillow (7) is relatively simple. This pillow (7) is designed to have the same width as the sleeping bag (6) it lies within. It is placed at the bottom layer of the sleeping bag (6) and is meant for the individual to rest his head upon. Its purpose is to prevent the sleeping bag (6) from sticking to and wrapping around the individual's head due to the pressure from the surrounding water and disabling normal breathing. In addition it lifts the individual's head slightly above the individual's feet so blood flow will not concentrate in the head causing unnecessary discomfort and health complication. The amount of air within this pillow (7) can be determined according to consumer need. The fourth and last aspect of the sleeping is the air flow process via the air tubes at the foot of the sleeping bag numbered (11) in the drawing. At the foot of the sleeping bag (6) there are two air tubes (11), these tubes (11) must also be made from latex rubber material to produce spiral air tubes (11). These spiral rubber tubes (11) must also have resilience, durability and flexibility. When the sleeping bag (6) is being lifted or lowered into the water, these tubes (11) must have the flexibility to expand and contract to compliment the movement of the sleeping bag (6). The other end of these rubber air tubes (11) are connected to a small air pump. Through this pump, fresh air can periodically but slowly enter the sleeping bag (6) and air can be easily distributed throughout the inside of the sleeping bag (6). The temperature of this ingoing air can be adjusted and controlled. The purpose of this is to prevent the individual from feeling stuffy within the sleeping bag (6) while preventing the sleeping bag (6) from wrapping around the individual due to pressure from the surrounding water, disabling the individual from freely moving. The air enters from the rubber air tubes (11), flows through the sleeping bag (6) and exits via the well-shaped opening. This ensures that the individual will constantly receive fresh, circulating air.

Figure 7:
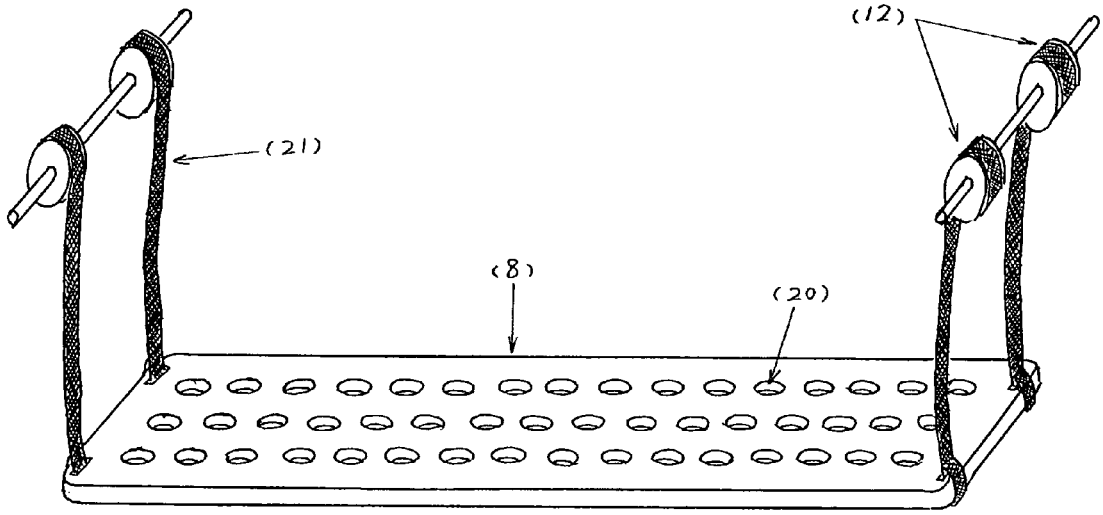
FIG. 7 is a partially sectional enlarged view of the sleeping bag of the floating water bed according to the above preferred embodiment of this invention.

The other special quality of this Floating Water bed is the movable mattress pad. The structures of this movable mattress pad are clearly depicted in FIG. 3, FIG. 4 and FIG. 7. From these drawings label number (8) clearly depicts a big mattress pad. It is a relatively flat area on which the sleeping bag (6) can be laid. The size of this movable mattress pad are approximately 75 inches in length, 40 inches in width, and 2 inches in thickness (75"×40"×2"). This mattress pad (8) should be made from strong and durable plastic or nylon to ensure that it can adequately support the weight of any person. On the mattress pad (8) are many specially designed holes labeled number (20) in the drawings. The diameters of these holes (20) are approximately Φ2 inches. The purpose of these holes (20) is to allow water to easily pass through and reduce the resistance between the pad (8) and the water as the pad (8) is being moved up and down. At the each end of the mattress pad (8) there are two rectangular shaped holes each 2 inches in length and 1 inch in width (2"×1"). These rectangular holes are designed so that rotating belts could be looped through these holes; these rotating belts are numbered (21) in the drawings. As one end of these rotating belts (21) are attached to the rectangular holes on the ends of the mattress pad (8), the other end is attached so rotating wheels at the top ends of the water tub (9). These rotating wheels are numbered (12) in the drawings. As the rotating wheels (12) rotate to contract the belts (21), the mattress pad (8) will then be slowly moved out of the water and lifted towards the surface of the bed. The individual along with the sleeping bag (6) will also leave the water via the mattress pad and the lifted towards the top of the bed. When the rotating wheels (12) rotate to expand the belts (21), it will slowly lower the mattress pad (8) back into the water. The sleeping bag (6) will also reenter the water along with the mattress pad (8). Rotating belts (21) should be made from thin strings of nylon netted together to produce these thick and sturdy belts. By netting together fine strings of nylon, it can ensure that the belt will have adequate strength and durability to accept the full weight of any individual. In addition, these belts will not deteriorate due to long period of time soaking in water. The purpose of the movable mattress pad (8) is, when the mattress pad (8) is above the water at the top of the bed a human being will have easy access in and out of the sleeping bag (6). When the mattress pad (8) is being the water, it will bring the sleeping bag (6) and the individual inside slowly down into the water as well until the individual is floating in mid-water. In case there is a leak in the sleeping bag (6), the protection circuit board will automatically rotate the rotation wheels (12) and lift the mattress pad (8) out of the power and raise it to the surface, thereby bringing the sleeping bag (6) and the individual out of the water as well. This will ensure the absolute safety of the individual inside the sleeping bag (6). In addition, at the head, body and feet of the sleeping bag (6) there exists eight places in which netted nylon belts are looped to secure the sleeping bag (6) to the movable mattress pad (8). These eight nylon belts are numbered (14) in the drawings. The length of these netted nylon belts (14) should be approximately 5 inches, this allows the sleeping bag (6) to float freely on its own without it rotating in uncomfortable positions bringing unnecessary discomfort or anxiety to the individual inside.

Lastly, in the bottom of the Floating Water Bed's water tub, there exist many electro-thermal wires or heat emitting light bulbs. The purpose of these wires or bulbs is to control the temperature of the water all year round to ensure a comfortable environment for the individual inside to receive abundant amounts of rest and relaxation.

Regarding the specific details of the temperature control system, protection circuit board, rotation system, and all other electric controls of the Floating Water Bed can be varied because there already exists many systems and designs that can adequately serve these purpose. Therefore, the details of these systems are not listed within this patent document and are not considered a crucial part of this new design. There will be not further details regarding these systems listed.

I claim:

1. A floating water bed, including:

a movable mattress pad, and a soft and thin sleeping bag which is placed flatly on said mattress pad, wherein said sleeping bag is capable of being lowered into water via said movable mattress pad, wherein said sleeping bag is adapted for a human being to rest therein in such a manner that the human being inside said sleeping bag is able to be lowered into the water so that the human being floats in mid-water within said sleeping bag, wherein said sleeping bag is adapted for allowing the human being to achieve absolute relaxation and rest, wherein said sleeping bag is adapted for completely separating the human being from the water surrounding said sleeping bag;

wherein air tubes are provided at an end of said sleeping bag, wherein an air pump is connected to said tubes to periodically and slowly release air into said sleeping bag, wherein an amount of air is pumped into said sleeping bag and a temperature of the air is adapted to be adjusted and controlled, wherein the air from said air pump enters into said sleeping bag via said air tubes, travels through said sleeping bag and leaves via a hole directly above a head of said sleeping bag, whereby periodically pumping the air into said sleeping bag, the air prevents the human being inside said sleeping bag from feeling stuffy as well as prevents said sleeping bag from tightly wrapping around the human being so as to ensure the human being receiving fresh air constantly, wherein due to a pressure exerted by the water surrounding, the human being is disabled from moving freely.

2. The floating water bed, as recited in claim 1, further including a water tub for receiving the water therein, wherein said sleeping bag is disposed in said water tub for enabling the human inside said sleeping bag floating in mid-water via said water tub, wherein heating means is provided at a bottom of said water tub for maintaining comfortable water temperature.

3. A floating water bed, including:

a movable mattress pad, and a soft and thin sleeping bag which is placed flatly on said mattress pad, wherein said sleeping bag is capable of being lowered into water via said movable mattress pad, wherein said sleeping bag is adapted for a human being to rest therein in such a manner that the human being inside said sleeping bag is able to be lowered into the water so that the human being floats in mid-water within said sleeping bag, wherein said sleeping bag is adapted for allowing the human being to achieve absolute relaxation and rest, wherein said sleeping bag is adapted for completely separating the human being from the water surrounding said sleeping bag;

wherein a well-shaped hole is provided above a head of said sleeping bag, wherein said hole is perpendicular to said sleeping bag and rises above the water, wherein fan-like textures are provided on front and sides of said hole for easy expansion and contraction of said hole for the human being easily entering into said sleeping bag and for the human being breathing normally and easily;

wherein air tubes are provided at an end of said sleeping bag, wherein an air pump is connected to said tubes to periodically and slowly release air into said sleeping bag, wherein an amount of air is pumped into said sleeping bag and a temperature of the air is adapted to be adjusted and controlled, wherein the air from said air pump enters into said sleeping bag via said air tubes, travels through said sleeping bag and leaves via said hole directly above said head of said sleeping bag, whereby periodically pumping the air into said sleeping bag, the air prevents the human being inside said sleeping bag from feeling stuffy as well as prevents said sleeping bag from tightly wrapping around the human being so as to ensure the human being receiving fresh air constantly, wherein due to a pressure exerted by the water surrounding, the human being is disabled from moving freely.

4. The floating water bed, as recited in claim 3, further including an air-filled pillow directly below said head of said sleeping bag, wherein said pillow is adapted to prevent said sleeping bag from wrapping around said head of the human being inside, whereby due to a pressure of the water surrounding, the human being is disabled from breathing, so that when the human being floats mid-water, a head of the human being is constantly lifted slightly higher than the feet thereof for enhancing blood circulation of the human being.

5. The floating water bed, as recited in claim 3, further including an outer most layer which is a waterproof layer made from latex rubber, an inner most layer made from corduroy and flannel material, and a middle layer which is a protection layer, wherein said inner most layer forms an inner side of said sleeping bag for providing comfort to the human being inside said sleeping beg, wherein a thin layer of soft plastic with circuit traces printed thereon by using a mixture of fine conduction powder and glue, wherein said circuit traces are divided into positive traces and negative traces, wherein by using an interchanging pattern of positive negative and negative positive, said circuit traces are places closely together in a parallel manner, wherein in the presence of the water, said circuit traces are automatically charged and signal a protection circuit board to rise said mattress pad from the water along with said sleeping bag and the human being inside for ensuring a safety of the human being within said sleeping bag, wherein an amount of electrolysis material is presented in the water to increase an ability of conducing electricity of the water.

6. The floating water bed, as recited in claim 3, further including a water tub for receiving the water therein, wherein said sleeping bag is disposed in said water tub for enabling said sleeping bag and the human floating in mid-water via said water tub, wherein heating means is provided at a bottom of said water tub for maintaining comfortable water temperature.

7. The floating water bed, as recited in claim 4, further including a water tub for receiving the water therein, wherein said sleeping bag is disposed in said water tub for enabling said sleeping bag and the human floating in mid-water via said water tub, wherein heating means is provided at a bottom of said water tub for maintaining comfortable water temperature.

8. The floating water bed, as recited in claim 5, further including a water tub for receiving the water therein, wherein said sleeping bag is disposed in said water tub for enabling said sleeping bag and the human floating in mid-water via said water tub, wherein heating means is provided at a bottom of said water tub for maintaining comfortable water temperature.

9. A floating water bed, including:

a movable mattress pad;

a soft and thin sleeping bag which is placed flatly on said mattress pad, wherein said sleeping bag is capable of being lowered into water via said movable mattress pad, wherein said sleeping bag is adapted for a human being to rest therein in such a manner that the human being inside said sleeping bag is able to be lowered into the water so that the human being floats in mid-water within said sleeping bag, wherein said sleeping bag is adapted for allowing the human being to achieve absolute relaxation and rest, wherein said sleeping bag is adapted for completely separating the human being from the water surrounding said sleeping bag, wherein a well-shaped hole is provided above a head of said sleeping bag, wherein said hole is perpendicular to said sleeping bag and rises above the water, wherein fan-like textures are provided on front and sides of said hole for easy expansion and contraction of said hole for the human being easily entering into said sleeping bag and for the human being breathing normally and easily; and an air-filled pillow directly below said head of said sleeping bag, wherein said pillow is adapted to prevent said sleeping bag from wrapping around said head of the human being inside, whereby due to a pressure of the water surrounding, the human being is disabled from breathing, so that when the human being floats mid-water, a head of the human being is constantly lifted slightly higher than the feet thereof for enhancing blood circulation of the human being.

10. The floating water bed, as recited in claim 9, further including an outer most layer which is a waterproof layer made from latex rubber, an inner most layer made from corduroy and flannel material and a middle layer which is a protection layer, wherein said inner most layer forms an inner side of said sleeping bag for providing comfort for the human being inside said sleeping bag, wherein a thin layer of soft plastic with circuit traces printed thereon by using a mixture of fine conduction powder and glue, wherein said circuit traces are divided into positive traces and negative traces, wherein by using an interchanging pattern of positive negative and negative positive, said circuit traces are places closely together in a parallel manner, wherein said circuit traces are automatically charged and signal a protection circuit board to rise said mattress pad from the water along with said sleeping bag and the human being inside for ensuring a safety of the human being within said sleeping bag, wherein an amount of electrolysis material is presented in the water to increase an ability of conducing electricity of the water.

11. The floating water bed, as recited in claim 9, further including a water tub for receiving the water therein, wherein said sleeping bag is disposed in said water tub for enabling said sleeping bag and the human floating in mid-water via said water tub, wherein heating means is provided at a bottom of said water tub for maintaining comfortable water temperature.

12. The floating water bed, as recited in claim 10, further including a water tub for receiving the water therein, wherein said sleeping bag is disposed in said water tub for enabling said sleeping bag and the human floating in mid-water via said water tub, wherein heating means is provided at a bottom of said water tub for maintaining comfortable water temperature.

13. A floating water bed, including:

a movable mattress pad;

a soft and thin sleeping bag which is placed flatly on said mattress pad, wherein said sleeping bag is capable of being lowered into water via said movable mattress pad, wherein said sleeping bag is adapted for a human being to rest therein in such a manner that the human being inside said sleeping bag is able to be lowered into the water so that the human being floats in mid-water within said sleeping bag, wherein said sleeping bag is adapted for allowing the human being to achieve absolute relaxation and rest, wherein said sleeping bag is adapted for completely separating the human being from the water surrounding said sleeping bag; and an outer most layer which is a waterproof layer made from latex rubber, an inner most layer made from corduroy and flannel material, and a middle layer which is a protection layer, wherein said inner most layer forms an inner side of said sleeping bag for providing comfort to the human being inside said sleeping bag, wherein a thin layer of soft plastic with circuit traces printed thereon by using a mixture of fine conduction powder and glue, wherein said circuit traces are divided into positive traces and negative traces, wherein by using an interchanging pattern of positive negative and negative positive, said circuit traces are places closely together in a parallel manner, wherein said circuit traces are automatically charged and signal a protection circuit board to rise said mattress pad from the water along with said sleeping bag and the human being inside for ensuring a safety of the human being within said sleeping bag, wherein an amount of electrolysis material is presented in the water to increase an ability of conducing electricity of the water.

14. The floating water bed, as recited in claim 13, further including a water tub for receiving the water therein, wherein said sleeping bag is disposed in said water tub for enabling said sleeping bag and the human floating in mid-water via said water tub, wherein heating means is provided at a bottom of said water tub for maintaining comfortable water temperature.

15. A floating water bed, including:

a movable mattress pad;

a soft and thin sleeping bag which is placed flatly on said mattress pad, wherein said sleeping bag is capable of being lowered into water via said movable mattress pad, wherein said sleeping bag is adapted for a human being to rest therein in such a manner that the human being inside said sleeping bag is able to be lowered into the water so that the human being floats in mid-water within said sleeping bag, wherein said sleeping bag is adapted for allowing the human being to achieve absolute relaxation and rest, wherein said sleeping bag is adapted for completely separating the human being from the water surrounding said sleeping bag, wherein a well-shaped hole is provided above a head of said sleeping bag, wherein said hole is perpendicular to said sleeping bag and rises above the water, wherein fan-like textures are provided on front and sides of said hole for easy expansion and contraction of said hole for the human being easily entering into said sleeping bag and for the human being breathing normally and easily; and an outer most layer which is a waterproof layer made from latex rubber, an inner most layer made from corduroy and flannel material, and a middle layer which is a protection layer, wherein said inner most layer forms an inner side of said sleeping bag for providing comfort to the human being inside said sleeping bag, wherein a thin layer of soft plastic with circuit traces printed thereon by using a mixture of fine conduction powder and glue, wherein said circuit traces are divided into positive traces and negative traces, wherein by using an interchanging pattern of positive negative and negative positive, said circuit traces are places closely together in a parallel manner, wherein said circuit traces are automatically charged and signal a protection circuit board to rise said mattress pad from the water along with said sleeping bag and the human being inside for ensuring a safety of the human being within said sleeping bag, wherein an amount of electrolysis material is presented in the water to increase an ability of conducing electricity of the water.

16. The floating water bed, as recited in claim 15, further including a water tub for receiving the water therein, wherein said sleeping bag is disposed in said water tub for enabling said sleeping bag and the human floating in mid-water via said water tub, wherein heating means is provided at a bottom of said water tub for maintaining comfortable water temperature.

17. A floating water bed, including:

a movable mattress pad;

a soft and thin sleeping bag which is placed flatly on said mattress pad, wherein said sleeping bag is capable of being lowered into water via said movable mattress pad, wherein said sleeping bag is adapted for a human being to rest therein in such a manner that the human being inside said sleeping bag is able to be lowered into the water so that the human being floats in mid-water within said sleeping bag, wherein said sleeping bag is adapted for allowing the human being to achieve absolute relaxation and rest, wherein said sleeping bag is adapted for completely separating the human being from the water surrounding said sleeping bag; and a water tub for receiving the water therein, wherein said sleeping bag is disposed in said water tub for enabling said sleeping bag and the human floating in mid-water via said water tub, wherein heating means is provided at a bottom of said water tub for maintaining comfortable water temperature.

18. A floating water bed, including:

a movable mattress pad;

a soft and thin sleeping bag which is placed flatly on said mattress pad, wherein said sleeping bag is capable of being lowered into water via said movable mattress pad, wherein said sleeping bag is adapted for a human being to rest therein in such a manner that the human being inside said sleeping bag is able to be lowered into the water so that the human being floats in mid-water within said sleeping bag, wherein said sleeping bag is adapted for allowing the human being to achieve absolute relaxation and rest, wherein said sleeping bag is adapted for completely separating the human being from the water surrounding said sleeping bag, wherein a well-shaped hole is provided above a head of said sleeping bag, wherein said hole is perpendicular to said sleeping bag and rises above the water, wherein fan-like textures are provided on front and sides of said hole for easy expansion and contraction of said hole for the human being easily entering into said sleeping bag and for the human being breathing normally and easily; and a water tub for receiving the water therein, wherein said sleeping bag is disposed in said water tub for enabling said sleeping bag and the human floating in mid-water via said water tub, wherein heating means is provided at a bottom of said water tub for maintaining comfortable water temperature.

* * * * *